US007614381B2

(12) United States Patent
Hoff et al.

(10) Patent No.: US 7,614,381 B2
(45) Date of Patent: Nov. 10, 2009

(54) POWER SYSTEM WITH AN INTEGRATED LUBRICATION CIRCUIT

(75) Inventors: Brian D. Hoff, East Peoria, IL (US); Sivaprasad Akasam, Peoria, IL (US); Marcelo C. Algrain, Peoria, IL (US); Kris W. Johnson, Washington, IL (US); William H. Lane, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 181 days.

(21) Appl. No.: 10/738,169

(22) Filed: Dec. 18, 2003

(65) Prior Publication Data

US 2004/0187834 A1 Sep. 30, 2004

Related U.S. Application Data

(60) Provisional application No. 60/458,460, filed on Mar. 28, 2003.

(51) Int. Cl.
*F01M 1/04* (2006.01)

(52) U.S. Cl. ..... 123/196 R; 184/6.5

(58) Field of Classification Search ..... 123/196 R, 123/142.5 R, DIG. 8; 184/6.5
See application file for complete search history.

(56) References Cited

U.S. PATENT DOCUMENTS

| | | | | |
|---|---|---|---|---|
| 4,424,775 | A * | 1/1984 | Mayfield et al. | 123/142.5 R |
| 4,682,649 | A | 7/1987 | Greer | |
| 4,755,110 | A * | 7/1988 | Bauer et al. | 417/364 |
| 4,756,359 | A | 7/1988 | Greer | |
| 5,509,381 | A * | 4/1996 | Fisher | 123/41.31 |
| 5,528,901 | A | 6/1996 | Willis | |
| 5,890,365 | A * | 4/1999 | Sisti | 60/709 |
| 6,167,978 | B1 * | 1/2001 | Smietanski | 180/69.4 |
| 6,470,844 | B2 * | 10/2002 | Biess | 123/142.5 R |

FOREIGN PATENT DOCUMENTS

RU 2151906 C1 * 6/2000

OTHER PUBLICATIONS

Partial English translation of Russian publication No. RU 2151 906 Cl, published Jun. 27, 2000.

* cited by examiner

*Primary Examiner*—Noah Kamen
(74) *Attorney, Agent, or Firm*—Finnegan, Henderson, Farabow, Garrett & Dunner

(57) ABSTRACT

A power system includes an engine having a first lubrication circuit and at least one auxiliary power unit having a second lubrication circuit. The first lubrication circuit is in fluid communication with the second lubrication circuit.

22 Claims, 2 Drawing Sheets

POWER SYSTEM WITH AN INTEGRATED LUBRICATION CIRCUIT

CLAIM FOR PRIORITY

This application claims the benefit of U.S. Provisional Application No. 60/458,460, filed Mar. 28, 2003.

U.S. GOVERNMENT RIGHTS

This invention was made with government support under the terms of Contract No. DE-FC04-2000AL67017 awarded by the Department of Energy. The government may have certain rights in this invention.

TECHNICAL FIELD

The present invention relates generally to a lubrication circuit, and more particularly, to an integrated lubrication circuit for a power system.

BACKGROUND

Work machines, including on-highway vehicles, may have a main power source for moving the work machine. The main power source may also be used to power electrical accessories including, for example, an air conditioning system, a heater, lights, and various other accessories. The main power source may be an engine such as a diesel engine, a gasoline engine, a natural gas engine, or any other type of engine that may be used for powering a work machine.

The main power source must be running to power the electrical accessories of the work machine with the main power source. This may lead to idling the main power source for extended periods. For example, while parked, a machine operator may have to idle the main power source to power the air conditioner, a TV, or other appliances. Such extended periods of idling can result in high fuel consumption, increased emissions, and increased wear of the main power source.

U.S. Pat. No. 5,528,901 (the '901 patent), issued to Willis on Jun. 25, 1996, describes the use of an auxiliary power unit (APU) to meet the power demands of the work machine without necessarily idling the main power source for extended periods. The APU is a secondary engine that produces power that may be used to provide for the accessory electrical loads of the work machine. The APU may allow the main power source of the work machine to be turned off when the APU power generating capacity is sufficient to meet the demands of the accessory electrical loads of the work machine.

The APU described in the '901 patent may also aid in cold starting situations. Specifically, the APU may be used to pass oil, warmed by the APU, to or through the main power source prior to starting the main power source. The warm oil circulating through the main power source increases main power source temperature, which improves startability.

Although the APU of the '901 patent may alleviate some of the difficulty associated with cold starting and may provide additional power for the work machine, the separate main engine and APU lubrication systems of the '901 patent are problematic. For example, separate lubrication systems may require separate maintenance activities. As a result, the operator may be required to shut down the work machine a greater number of times in order to maintain the work machine. Shutting down in this way may reduce machine efficiency and increase operating costs. Further, separate fluid level inspections may have to be performed for the APU and the main engine. These added maintenance activities and inspections may also increase the opportunity for errors. In addition, the location of the APU within the work machine may increase the difficulty of the maintenance and inspection activities.

The present invention is directed to overcoming one or more of the problems set forth above.

SUMMARY OF THE INVENTION

In one aspect, the present disclosure is directed to a power system that includes an engine having a first lubrication circuit and at least one auxiliary power unit having a second lubrication circuit. The first lubrication circuit is in fluid communication with the second lubrication circuit.

In another aspect, the present disclosure is directed to a method of refreshing an oil supply in a power system including at least one auxiliary power unit having an auxiliary power unit lubrication circuit, and an engine having an engine lubrication circuit. The method includes pumping oil from the auxiliary power unit lubrication circuit to the engine lubrication circuit. The method also include pressurizing oil in the engine lubrication circuit and selectively allowing the pressurized oil to flow from the engine lubrication circuit to the auxiliary power unit lubrication circuit.

DETAILED DESCRIPTION

Figure 1:
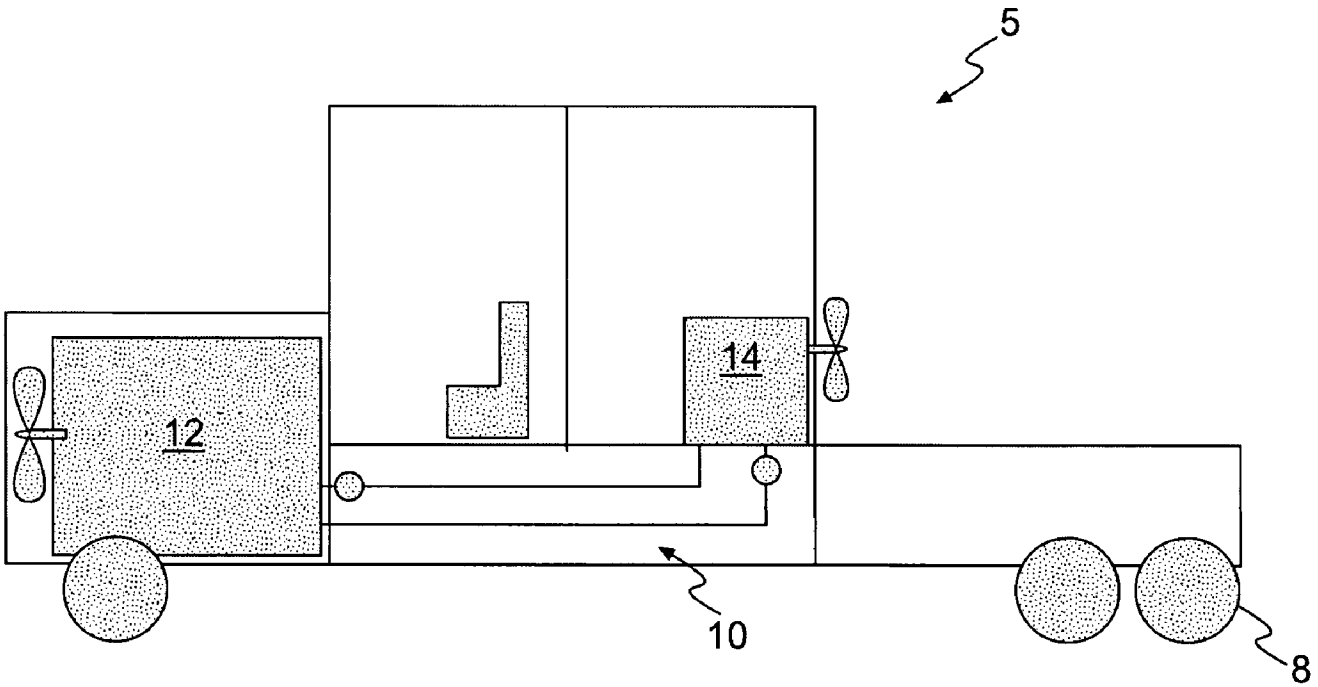
FIG. 1 is a pictoral illustration of a work machine having a power system according to an exemplary embodiment of the present invention.

FIG. 1 illustrates a work machine 5 having a traction device 8 and an exemplary embodiment of an integrated lubrication circuit 10. The integrated lubrication circuit 10 fluidly connects a lubrication system of a main engine 12 with the lubrication system of an auxiliary power unit (APU) 14. Main engine 12 may be any engine that utilizes an oil lubrication system such as, for example, a diesel engine, a gasoline engine, a natural gas engine, or a turbine engine. APU 14 may also be a diesel engine, a gasoline engine, a natural gas engine, a turbine engine or another power source having a lubrication system.

Figure 2:
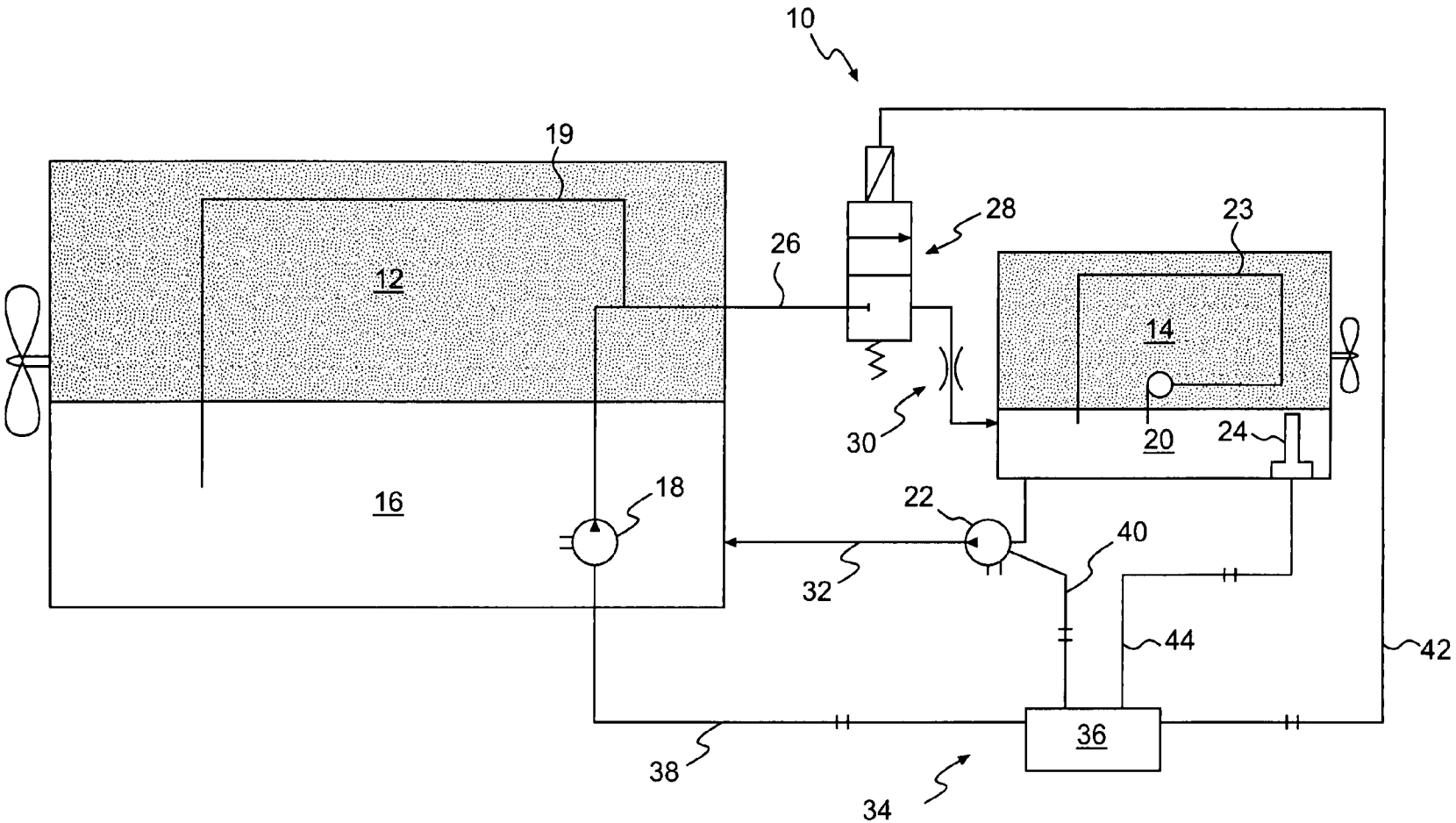
FIG. 2 is a schematic illustration of a power system according to an exemplary embodiment of the present invention.

As illustrated in FIG. 2, lubrication circuit 10 connecting main engine 12 to APU 14 may also include an engine oil sump 16, engine oil pump 18, an APU oil sump 20, an APU oil pump 22, and an oil level indicator 24.

Engine oil sump 16 may be connected to main engine 12 and may be in fluid communication with engine oil pump 18. Engine oil sump 16 may be a reservoir configured to hold a supply of oil. Engine oil pump 18 may be connected to main engine 12, but may be remotely located. Main engine 12 may include a separate lubrication circuit 19 for circulating oil through main engine 12. Engine oil pump 18 may be fluidly connected to engine lubrication circuit 19 to pressurize the oil in engine lubrication circuit 19. Alternately, engine oil pump 18 may be separate from engine 12 and may be dedicated for use with integrated lubrication circuit 10. Engine oil pump 18 may be electrically driven or may be coupled to main engine 12 in a direct drive configuration. Further, engine oil pump 18 may include a belt drive, a hydraulic drive, or any other appropriate drive arrangement.

APU oil sump 20 may be connected to APU 14 and may be in fluid communication with APU oil pump 22. APU oil sump 20 may be a reservoir configured to hold a supply of oil. It is also contemplated that APU oil sump 20 and engine oil sump 16 may be the same oil sump, and may or may not be located remotely. APU oil pump 22 may be connected to APU 14, or remotely located. APU 14 may include a separate lubrication circuit 23 for circulating oil through APU 14. APU oil pump 22 may be fluidly connected to APU lubrication circuit 23 to pressurize the oil in APU lubrication circuit 23. Alternately, APU oil pump 22 may be separate from APU 14 and may be dedicated for use with integrated lubrication circuit 10. APU oil pump 22 may be electrically driven or may be coupled to APU 14 in a direct drive configuration. Further, APU oil pump 22 may include a belt drive, a hydraulic drive, or any other appropriate drive arrangement.

APU 14 may also include an oil level indicator 24 configured to generate a signal indicative of the oil level in the APU oil sump 20. Oil level indicator 24 may be located inside or outside of APU oil sump 20, and may or may not be in fluid communication with APU oil sump 20.

APU lubrication circuit 23 of APU 14 may be fluidly connected to engine lubrication circuit 19 via fluid passageways 26 and 32. A solenoid valve 28 may be provided in fluid passageway 26 of integrated lubrication circuit 10 that is movable between a first position where fluid is allowed to flow relative to the valve, and a second position where fluid is blocked from flowing relative to the valve. For example, APU oil sump 20 may be in fluid communication with engine oil pump 18 via fluid passageway 26. Solenoid valve 28 is disposed in fluid passageway 26 and configured to selectively allow a flow of pressurized oil from engine lubrication circuit 19 to APU lubrication circuit 23 (e.g., to APU oil sump 20). Although solenoid valve 28 is illustrated in the disclosed embodiment, integrated lubrication circuit 10 may include any valve means for selectively allowing a flow of pressurized oil relative to the valve including, for example, a mechanically operated valve or a piezo-electric valve. APU oil pump 22 may be in fluid communication with engine lubrication circuit 19 (e.g., with engine oil sump 16) via fluid passageway 32.

An orifice 30 may also be disposed in fluid passageway 26, between solenoid valve 28 and APU oil sump 20. It is also contemplated that the orifice 30 may be disposed at any point in fluid passageway 26, between engine 12 and APU 14. Orifice 30 may be configured to control the rate of flow between engine oil pump 18 and APU oil sump 20. Orifice 30 may be a throttle valve, a fixed restrictive orifice, or any other any means for limiting the oil flow rate through fluid passageway 26.

Integrated lubrication circuit 10 may also include other components, such as filters (not shown), an oil cooler (not shown), additional check valves (not shown), etc. These other components may be part of the engine lubrication circuit 19, part of the APU lubrication circuit 23, or may be dedicated to integrated lubrication circuit 10.

Integrated lubrication circuit 10 may also include a control system 34 in communication with main engine 12, APU 14, and components of each. For example, control system 34 may include a controller 36 in communication with engine oil pump 18, APU oil pump 22, solenoid valve 28, and oil level indicator 24 via communication lines 38, 40, 42, and 44, respectively. Controller 36 may include components such as a memory, a secondary storage device, a processor, and other hardware components for running software applications. Controller 36 may also include power supply circuitry, signal conditioning circuitry, solenoid driver circuitry, and any other appropriate circuitry. It is also contemplated that the disclosed controlling functions of controller 36 may be performed by another controller of the work machine that performs additional controlling functions.

INDUSTRIAL APPLICABILITY

The disclosed integrated lubrication circuit may be applicable to any power system having a main engine and at least one APU. For these systems, integrated lubrication circuit 10 may allow for improved cold starting, reduced emissions, reduced maintenance, regular maintenance of the engine, extended engine life, and automatic maintenance of engine fluid levels.

Power systems having integrated lubrication system 10 may automatically refresh the lubrication oil of the APU. For example, controller 36 may initiate an oil-refreshing cycle for APU 14 after a predetermined period of APU operation. Specifically, each time APU 14 is activated, controller 36 may track the amount of time during which APU 14 is operated. This time may be added to a stored cumulative operating time value. Whenever the cumulative operating time value of the APU meets or exceeds a predetermined value, an APU oil refreshing cycle may be initiated. This predetermined value may represent a user input or may be one of a set of stored values corresponding to desired maintenance intervals.

Controller 36 may activate the oil-refreshing cycle through control of components of integrated lubrication circuit 10. Controller 36 activates APU oil pump 22 to pump a portion or all of the oil from APU oil sump 20 into engine oil sump 16. Controller 36 may deactivate APU oil pump 22 when controller 36 receives input from oil level indicator 24 that the oil in APU 14 is below a predetermined level. Alternately, controller 36 may deactivate APU oil pump 22 after a predetermined lapse activation time, or a combination of lapsed time and sensed oil level. Engine oil pump 18 may provide pressurized oil to fluid passageway 26. The opening of solenoid valve 28 may allow the pressurized oil to flow from fluid passageway 26 to APU lubrication system 23 (e.g. to oil sump 20).

Oil level indicator 24 may help to ensure proper oil levels in APU oil sump. For example, if oil level indicator 24 sends a signal to controller 36 indicative of an oil level below a predetermined level in APU oil sump 20, engine oil pump 18, if not already active, may be activated to pressurize oil in fluid passageway 26. Solenoid valve 28 may then be opened to allow pressurized oil to fill APU oil sump 20. In this manner, the fluid level of APU 14 may be automatically maintained at the predetermined level. Controls may be implemented to avoid over-filling APU oil sump 20. Orifice 30 may control the flow rate of the pressurized oil into APU oil sump 20 so that APU oil sump 20 does not fill up too quickly or become overfilled.

Integrated lubrication system 10 may offer one or more advantages over existing systems. For example, the need to perform the fluid checks of APU lubrication system 23 may be reduced and or eliminated. In addition, because the oil in APU 14 is periodically refreshed with main engine oil, there may never be a need to change the oil in APU 14. Integrated lubrication circuit 10 essentially ensures that regular maintenance is performed on APU 14, thereby extending the life of that component. The downtime of the machine for maintenance purposes may also be kept to a minimum. Integrated lubrication system 10 may facilitate starting in cold conditions by allowing a circulation of heated oil from APU 14 to main engine 12. Shorter starting times and quicker main engine warm-up may result in reduced emissions, less wear on main engine 12, and a reduction in the battery capacity required to start main engine 12.

It will be apparent to those skilled in the art that various modifications and variations can be made to integrated lubrication circuit 10 of the present invention without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A power system, comprising:

an engine having a first lubrication circuit inside the engine;

at least one auxiliary power unit having a second lubrication circuit inside the auxiliary power unit and configured to lubricate moving parts of the auxiliary power unit, the first lubrication circuit being in fluid communication with the second lubrication circuit; and a controllable valve operable to selectively allow fluid flow between the first lubrication circuit and the second lubrication circuit.

2. The power system of claim 1, further including:

a first pump configured to pump oil from the first lubrication circuit to the second lubrication circuit; and wherein the controllable valve is disposed between the first pump and the second lubrication circuit, and the controllable valve is movable between a first position where oil from the first pump is allowed to flow to the second lubrication circuit and a second position where oil is blocked from flowing from the first pump to the second lubrication circuit.

3. The power system of claim 2, wherein the controllable valve is moved from the second position to the first position after a predetermined period of operation of the at least one auxiliary power unit.

4. The power system of claim 2, further including a restrictive orifice disposed between the first pump and the at least one auxiliary power unit, the restrictive orifice configured to control the flow rate of pressurized oil pumped from the first lubrication circuit to the second lubrication circuit.

5. The power system of claim 2, wherein the pump is electrically driven.

6. The power system of claim 2, further including:

a second pump configured to pump oil from the second lubrication circuit to the first lubrication circuit;

a first oil sump operatively connected to the engine; and a second oil sump operatively connected to the at least one auxiliary power unit, the first pump being configured to pump oil into the second oil sump and the second pump being configured to pump oil into the first oil sump.

7. A method of refreshing and utilizing an oil supply in a power system including at least one auxiliary power unit having an auxiliary power unit lubrication circuit, and an engine having an engine lubrication circuit, the method comprising:

pumping oil from the auxiliary power unit lubrication circuit to the engine lubrication circuit;

pressurizing oil in the engine lubrication circuit;

selectively allowing pressurized oil to flow from the engine lubrication circuit to the auxiliary power unit lubrication circuit in response to a condition of the auxiliary power unit; and utilizing the auxiliary power unit lubrication circuit to lubricate moving parts of the auxiliary power unit.

8. The method of claim 7, further including restricting a flow rate of the pressurized oil.

9. The method of claim 7, further including:

sensing an oil level in the auxiliary power unit lubrication circuit; and initiating the step of selectively allowing the pressurized fluid to flow in response to sensing that the oil level is below a predetermined level.

10. A power system, comprising:

an engine having a first lubrication circuit;

at least one auxiliary power unit having a second lubrication circuit, the first lubrication circuit being in fluid communication with the second lubrication circuit;

a first pump configured to pump oil from the first lubrication circuit to the second lubrication circuit;

a controllable valve disposed between the first lubrication circuit and the second lubrication circuit, wherein the controllable valve is disposed between the first pump and the second lubrication circuit, and the controllable valve is movable between a first position where oil from the first pump is allowed to flow to the second lubrication circuit and a second position where oil is blocked from flowing from the first pump to the second lubrication circuit;

an oil level indicator configured to generate a signal indicative of an oil level in the second lubrication circuit; and a controller operable to receive the signal and configured to move the controllable valve from the second position to the first position when the signal indicates an oil level below a predetermined level.

11. A method of refreshing and utilizing an oil supply in a power system including at least one auxiliary power unit having an auxiliary power unit lubrication circuit, and an engine having an engine lubrication circuit, the method comprising:

pumping oil from the auxiliary power unit lubrication circuit to the engine lubrication circuit;

pressurizing oil in the engine lubrication circuit;

tracking a total operating time of the at least one auxiliary power unit; and selectively allowing pressurized oil to flow from the engine lubrication circuit to the auxiliary power unit lubrication circuit when the total operating time corresponds to one or more predetermined values.

12. A power system, comprising:

an engine having a first lubrication circuit;

at least one auxiliary power unit having a second lubrication circuit configured to lubricate moving parts of the auxiliary power unit;

a means for pressurizing oil in the first lubrication circuit;

a means for pumping oil from the second lubrication circuit to the first lubrication circuit; and a means for selectively allowing the pressurized oil to flow to the second lubrication circuit in response to a condition of the auxiliary power unit.

13. The power system of claim 12, wherein the means for selectively allowing the pressurized oil to flow to the second lubrication circuit is actuated in response to a predetermined period of operation of the at least one auxiliary power unit.

14. The power system of claim 12, further including:

a means for generating a signal indicative of an oil level in the second lubrication circuit; and a means for actuating the means for selectively allowing the pressurized oil to flow to the second lubrication circuit in response to the signal having a value that indicates an oil level below a predetermined level.

15. The power system of claim 12, further including a means for controlling the flow rate of oil from the first lubrication circuit to the second lubrication circuit.

16. A machine, comprising:

a traction device;

a housing supported by the traction device; and a power system for driving the traction device, the power system comprising:

an engine having a first lubrication circuit;

at least one auxiliary power unit having a second lubrication circuit configured to lubricate moving parts of the auxiliary power unit, the first lubrication circuit being in fluid communication with the second lubrication circuit; and a controllable valve disposed between the first lubrication circuit and the second lubrication circuit, the controllable valve being operable to selectively allow fluid flow from the first lubrication circuit to the second lubrication circuit.

17. The machine of claim 16, further including:

a first pump configured to pump oil from the first lubrication circuit to the second lubrication circuit; and wherein the controllable valve is disposed between the first pump and the second lubrication circuit, and the controllable valve is movable between a first position where oil from the first pump is allowed to flow to the second lubrication circuit and a second position where oil is blocked from flowing from the first pump to the second lubrication circuit.

18. The machine of claim 17, wherein the controllable valve is moved from the second position to the first position after a predetermined period of operation of the at least one auxiliary power unit.

19. The machine of claim 17, further including:

an oil level indicator configured to generate a signal indicative of an oil level in the second lubrication circuit; and a controller operable to receive the signal and configured to move the controllable valve from the second position to the first position when the indicated oil level is below a predetermined level.

20. The machine of claim 17, further including a restrictive orifice disposed between the first pump and the at least one auxiliary power unit, the restrictive orifice configured to control the flow rate of oil pumped from the first lubrication circuit to the second lubrication circuit.

21. The machine of claim 17, wherein the pump is electrically driven.

22. The machine of claim 17, further including:

a second pump configured to pump oil from the second lubrication circuit to the first lubrication circuit;

a first oil sump operatively connected to the engine; and a second oil sump operatively connected to the at least one auxiliary power unit, the first pump being configured to pump oil into the second oil sump and the second pump being configured to pump oil into the first oil sump.

* * * * *